US006776092B2

(12) United States Patent
Geider et al.

(10) Patent No.: US 6,776,092 B2
(45) Date of Patent: Aug. 17, 2004

(54) ROTARY LEAD-THROUGH ASSEMBLY FOR SUPPLYING AN OPERATING FLUID TO A ROTOR OF A MACHINE FOR PROCESSING PRINTING MATERIAL

(75) Inventors: Andreas Geider, St. Leon-Rot (DE); Rolf Kündgen, Eppelheim (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 10/390,866

(22) Filed: Mar. 17, 2003

(65) Prior Publication Data

US 2003/0172820 A1 Sep. 18, 2003

(30) Foreign Application Priority Data

Mar. 15, 2002 (DE) ..... 102 11 453

(51) Int. Cl.[7] ..... B41F 5/00
(52) U.S. Cl. ..... 101/216; 101/375
(58) Field of Search ..... 101/216, 375, 101/378, 389.1, 415.1

(56) References Cited

U.S. PATENT DOCUMENTS 5,255,604 A 10/1993 Dürr
5,439,029 A 8/1995 Becker
5,440,989 A 8/1995 Becker
5,588,363 A 12/1996 Becker

FOREIGN PATENT DOCUMENTS

DE 42 03 550 A1 8/1993
DE 42 10 009 A1 9/1993
DE 43 06 139 A1 9/1994
DE 44 01 684 C2 7/1995

*Primary Examiner*—Ren Yan
(74) *Attorney, Agent, or Firm*—Laurence A. Greenberg; Werner H. Stemer; Gregory L. Mayback

(57) ABSTRACT

A rotary lead-through assembly supplies an operating fluid to a rotor of a machine for processing printing material. An operating cylinder includes an expansion chamber and a piston having a piston outlet opening. The piston is mounted so as to be displaceable towards the rotor for coupling a rotor inlet opening and the piston outlet opening with one another. A pressure generator is connected both to the expansion chamber and to the rotor, when the openings are coupled with one another. A threshold value valve is disposed between the expansion chamber and the piston outlet opening. The valve is automatically openable when a given threshold value of an excess pressure of the operating fluid is exceeded. A machine for processing printing material is also provided.

5 Claims, 4 Drawing Sheets

ROTARY LEAD-THROUGH ASSEMBLY FOR SUPPLYING AN OPERATING FLUID TO A ROTOR OF A MACHINE FOR PROCESSING PRINTING MATERIAL

BACKGROUND OF THE INVENTION

Field of the Invention

The invention relates to a rotary lead-through assembly or bushing for supplying an operating fluid to a rotor of a machine for processing printing material. The rotor is provided with a rotor inlet opening, an operating cylinder formed with an expansion chamber, and a piston. The piston is provided with a piston outlet opening and is mounted so as to be displaceable towards the rotor. A pressure generator is connected both to the expansion chamber and to the rotor, when the openings are coupled with one another.

FIGS. 2 to 4 of German Patent DE 42 03 550 C2 show a rotary lead-through, the piston of which is mounted so as to be displaceable in radial direction with respect to the rotor. That rotor is a cylinder axle journal. A piston bore passing through the piston has a throttling effect, based upon which, when compressed air is supplied to the side of the piston facing away from the rotor, a positive pressure setting the piston against the rotating rotor is built up when compressed air is supplied to the side of the piston facing away from the rotor. While the piston is set against the rotor, the compressed air can escape into the surroundings through the piston bore, as long as the piston does not yet rest on the rotor. That leakage leads, on the one hand, to a reduced reaction speed of the piston and, on the other hand, to a noise nuisance, and presupposes that the pressure generator has a high capacity.

A further rotary lead-through or bushing, corresponding to the general type mentioned in the introduction hereto, is described in German Patent DE 42 10 009 C1 (note FIG. 1 thereof) wherein, when the rotor is at a standstill, the piston outlet opening is coupled to the rotor inlet opening by the piston being set against the rotor.

In the last-identified German Patent DE 42 10 009 C1, just as in the description of the invention of the instant application, the selection of the term "rotary lead-through assembly" is in no way intended to express the concept that the operating fluid is introduced into the rotor via the rotary lead-through while the rotor is rotating. Instead, the choice of the term is merely intended to express the concept that the operating fluid is introduced through the intermediary of the lead-through into a machine element that is mounted so as to be rotatable, in particular the rotor.

SUMMARY OF THE INVENTION

It is accordingly an object of the invention to provide a rotary lead-through assembly or bushing for supplying an operating fluid to a rotor of a machine for processing printing material, which overcomes the hereinaforementioned disadvantages of the heretofore-known devices of this general type and with which leakage of the operating fluid is minimized.

With the foregoing and other objects in view, there is provided, in accordance with the invention, a rotary lead-through assembly for supplying an operating fluid to a rotor of a machine for processing printing material. The rotary lead-through assembly comprises an operating cylinder including an expansion chamber, and a piston provided with a piston outlet opening. The piston is mounted so as to be displaceable towards the rotor for coupling a rotor inlet opening and the piston outlet opening with one another. A pressure generator is connected both to the expansion chamber and to the rotor, when the openings are coupled with one another. A threshold value valve is disposed between the expansion chamber and the piston outlet opening. The valve is automatically openable when a given threshold value of an excess pressure of the operating fluid is exceeded.

In accordance with another feature of the invention, the threshold value valve has a valve element. A valve spring serves for determining the threshold value and the valve element is loadable by the valve spring.

In accordance with a further feature of the invention, the valve element is mounted so as to be displaceable away from a valve opening of the threshold value valve under increasing tensioning of the valve spring.

In accordance with an added feature of the invention, the piston outlet opening is a circularly arcuate groove formed at one end of the piston.

With the objects of the invention in view, there is also provided a machine for processing printing material, comprising a rotor formed with a rotor inlet opening, and a rotary lead-through assembly for supplying an operating fluid to the rotor. The rotary lead-through assembly includes an operating cylinder having an expansion chamber, and a piston provided with a piston outlet opening. The piston is mounted so as to be displaceable towards the rotor for coupling the rotor inlet opening and the piston outlet opening with one another. A pressure generator is connected both to the expansion chamber and to the rotor, when the openings are coupled with one another. A threshold value valve is disposed between the expansion chamber and the piston outlet opening. The valve is automatically openable when a given threshold value of an excess pressure of the operating fluid is exceeded.

An advantage of the rotary lead-through assembly according to the invention is that even while the piston is being set against the rotor, no significant losses of the operating fluid occur. Consequently, the action of setting the piston in place occurs with very little noise, and the capacity of the pressure generator does not have to be particularly high. The high reaction speed of the piston when positive pressure is applied thereto is a further advantage, which results from the sealing of the piston by the threshold value valve during the act of setting the piston in place.

In a development which is advantageous with regard to minimizing the production costs, a valve element of the threshold value valve is loaded by a valve spring that determines the threshold value. For example, a reversing or check valve which can be obtained rather inexpensively from suppliers can be used as the threshold value valve. The function of the valve is not only for preventing the operating fluid from returning but, going beyond this, for letting the operating fluid through, i.e., opening, only when the precisely determined threshold value is exceeded.

The valve element and the valve spring are disposed in such a way that the valve element is mounted so as to be displaceable away from a valve opening of the threshold value valve under increasing tension or stress on the valve spring as the threshold value valve opens.

In a development which is likewise advantageous with regard to cost-effective production, the piston outlet opening is a circularly arcuate groove formed at one end of the piston. The rotor inlet opening and a further rotor inlet opening can have a different angular offset in relation to one another in different series of the machines for processing printing material. In all of these series of construction, provision can additionally be made for the rotor to be rotated over exactly the same rotational angle in order to decouple the rotor inlet openings from the piston outlet opening and, at the same time, to couple the other of the rotor inlet openings to the piston outlet opening. As opposed to a circular piston outlet opening, for example a circular bore, the circularly arcuate groove permits the same piston to be used for any of the series. The circular arcuate form of the piston outlet opening, as compared with a conceivable circular segment form, for example a semicircular form, of the piston outlet opening, offers the advantage that the portion of the area of the rotor which is overlapped by the piston outlet opening and lies beside the rotor inlet opening when the openings are coupled is comparatively small: Therefore, the compressive force is also comparatively small, which results from the action of the positive or excess pressure on the aforementioned portion of the area, and attempts to force the piston away from the rotor have to be overcome by the pressure generator.

The machine for processing printing material, which is equipped with the rotary lead-through assembly, is preferably a printing press, for example a rotary press, and can also be a machine used in further processing in book binding or further printing material processing.

Other features which are considered as characteristic for the invention are set forth in the appended claims.

Although the invention is illustrated and described herein as embodied in a rotary lead-through assembly for supplying an operating fluid to a rotor of a machine for processing printing material, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
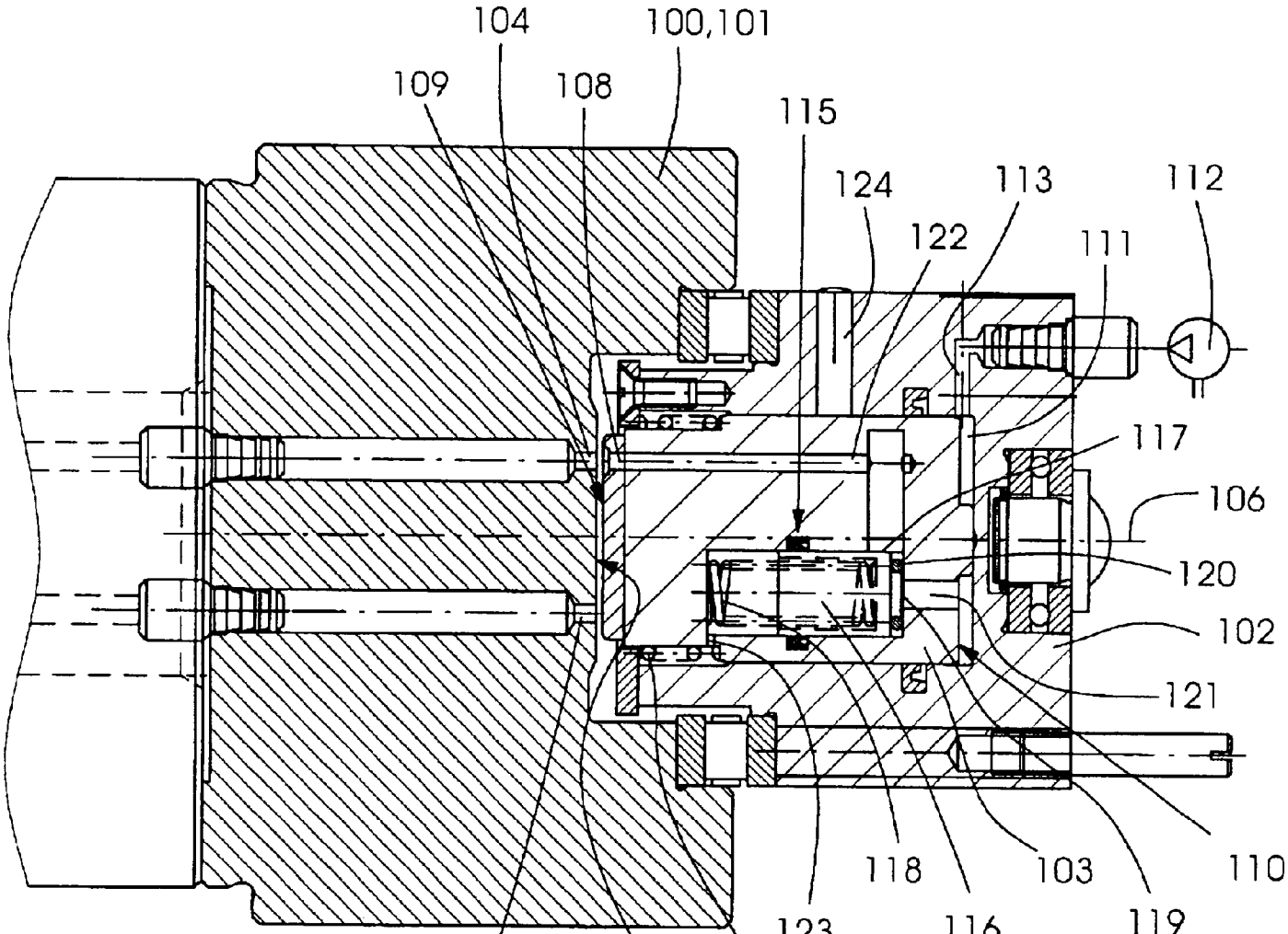
FIG. 1 is a fragmentary, diagrammatic, longitudinal-sectional view of a first exemplary embodiment of a machine for processing printing material incorporating a lead-through according to the invention, and having a threshold value valve disposed outside a piston.
Figure 2:
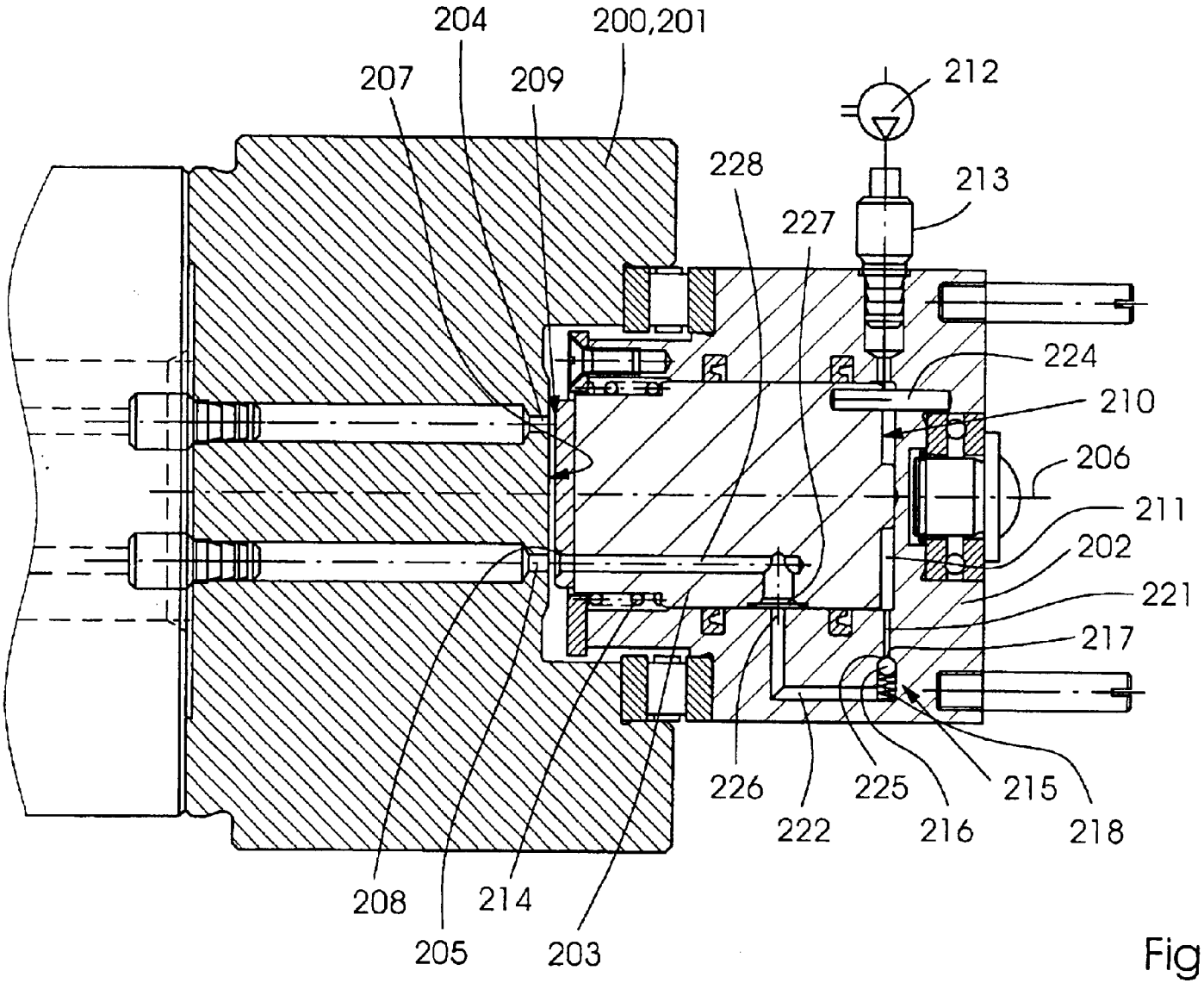
FIG. 2 is a view similar to FIG. 1 of a second exemplary embodiment of the printing-material processing machine wherein the threshold value valve is disposed inside the piston.

Referring now to the figures of the drawings in detail and first, particularly, to FIGS. 1 and 2 thereof, there is seen a fragmentary view of a respective machine 100, 200 for processing printing material. The illustrated fragmentary view is of a respective rotor 101, 201 of the respective machine 100, 200. What is not shown in the drawings are first and second devices belonging to the respective rotors 101, 201 and being adjustable via a gaseous operating fluid under excess or positive pressure, specifically compressed air, to be introduced into the respective rotor 101, 201 for this purpose. In more precise terms, the respective machine 100, 200 is a printing press, and the respective rotor 101, 201 is a plate cylinder. The first device is a pneumatically adjustable, front clamping device for firmly clamping a leading edge of a printing plate, and the second device is a pneumatically adjustable, rear clamping device for firmly clamping a trailing edge of the printing plate. Axially aligned with the respective rotor 101, 201 is a respective stator 102, 202 and a respective cylindrical piston (reciprocating piston) 103, 203 which is mounted so as to be displaceable towards and away from the respective rotor 101, 201 in the respective stator 102, 202.

The respective stator 102, 202 does not rotate together with the respective rotor 101, 201 during the operation of the respective rotor 101, 201 which, in the specific case at hand, is therefore during a printing operation.

A respective protective device 124, 224 is constructed in principle as a linear guide and includes a recess formed in the respective piston 103, 203, and a pin projecting into the recess and seated firmly in the respective stator 102, 202 (note the piston groove and transverse pin in FIG. 1, and the piston bore and longitudinal pin in FIG. 2). This permits the respective piston 103, 203 to be displaced towards and away from the respective rotor 101, 201, and secures the respective piston 103, 203 against rotation of the respective piston 103, 203 about a respective rotational axis 106, 206 relative to the respective stator 102, 202 and to the respective rotor 101, 201.

The respective rotor 101, 201 has a respective first rotor inlet opening 104, 204, via which the first device (front clamping device) can be supplied with the operating fluid. The respective rotor 101, 201 also has a respective second rotor inlet opening 105, 205, via which the second device (rear clamping device) can be supplied with the operating fluid. Both of the respective rotor inlet openings 104, 204; 105, 205 have at least approximately the same spacing from the respective rotational axis 106, 206 of the respective rotor 101, 201, and are introduced into a respective end stop surface 107, 207 of the respective rotor 101, 201.

The respective piston 103, 203 has a respective piston outlet opening 108, 208 for the operating fluid. The spacing of the respective piston outlet openings 108, 208 from the respective rotational axis 106, 206 corresponds approximately to the spacing of the respective rotor inlet openings 104, 204; 105, 205 from the respective rotational axis 106, 206. The respective piston outlet openings 108, 208 are introduced into a respective first end 109, 209 of the respective piston 103, 203, facing the respective stop surface 107, 207. The respective, somewhat bushing-shaped, stator 102, 202 and a respective second end 110, 210 of the respective piston 103, 203 together bound a respective expansion chamber 111, 211. A respective pressure generator 112, 212, which produces the excess or positive pressure of the operating fluid and is only illustrated diagrammatically, for example a compressor or some other compressed-air source, is connected to the respective expansion chamber 111, 211 via a respective feed channel 113, 213 belonging to the respective stator 102, 202 and opening into the respective expansion chamber 111, 211. The respective stator 102, 202 and the respective piston 103, 203 thus together form a pneumatic operating or reciprocating piston/cylinder. The respective piston 103, 203 is set against the respective stop surface 107, 207 due to the fact that the respective expansion chamber 111, 211 is being filled with the operating fluid, and due to an increasing stress on a respective return spring 114, 214 associated with the respective piston 103, 203.

A respective threshold value valve 115, 215 is disposed within a flow path of the operating fluid and between the respective expansion chamber 111, 211 and the respective piston outlet opening 108, 208. In terms of construction, the threshold value valves 115, 215 are very similar to a pressure limiting valve but have a function that differs therefrom. The respective threshold value valve 115, 215 opens automatically the instant that the excess or positive pressure of the operating fluid acting on a respective displaceably mounted valve element 116, 216 of the respective threshold value valve 115, 215 exceeds a specific threshold value (limiting value). When the respective threshold value valve 115, 215 is opened, the respective valve element 116, 216 opens a respective valve opening 117, 217, so that the operating fluid can flow through the latter. The threshold value is prescribed by a characteristic spring characteristic curve of a respective prestressed valve spring 118, 218, which returns the respective valve element 116, 216 and, as a result, closes the respective threshold value valve 115, 215 again the instant that the excess or positive pressure falls below the respective threshold value.

Figure 3:
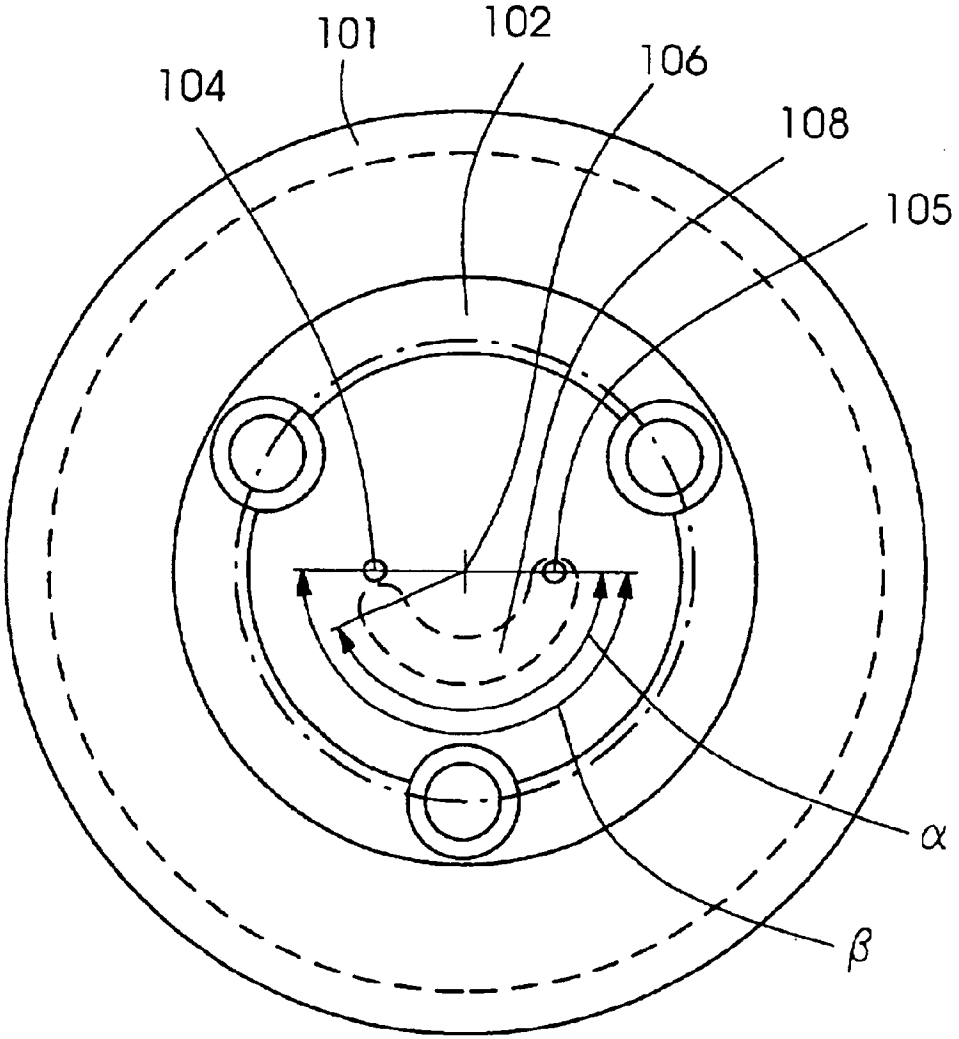
FIGS. 3 and 4 are cross-sectional views of FIGS. 1 and 2, respectively.

In the first exemplary embodiment of the rotary lead-through which is shown in FIGS. 1 and 3, the threshold value valve 115 is integrated into the piston 103. The valve element 116 is a valve piston and has a cylindrical shape. The valve opening 117 is an outlet opening and is disposed perpendicularly to an inlet opening 119 of the threshold value valve 115.

An end surface of the valve body 116, to which the operating fluid is applicable, faces the inlet opening 119 and is located on a ledge on the valve element 116. Pushed onto this ledge is an annular seal 120 which, when the threshold value valve 115 is closed, bears on an inner stop surface of the partially hollow piston 103, into which surface the inlet opening 119 is introduced. A circumferential surface of the valve element 116 faces the valve opening 117 and covers the latter when the threshold value valve 116 is closed, so that the operating fluid cannot flow through the threshold value valve 115.

A first connecting duct 121 in the piston 103 connects the expansion chamber 111 to the threshold value valve 115 and terminates in the inlet opening 119. A second connecting duct 122 in the piston 103, which is formed by two bores meeting one another at an angle, begins in the valve opening 117 and ends in the piston outlet opening 108. Furthermore, a vent duct 123 for the threshold value valve 115 is introduced into the piston 103. Air expelled from the piston 103 by the valve element 116 when the threshold value valve 115 is opened is able to escape through this vent duct 123.

Figure 4:
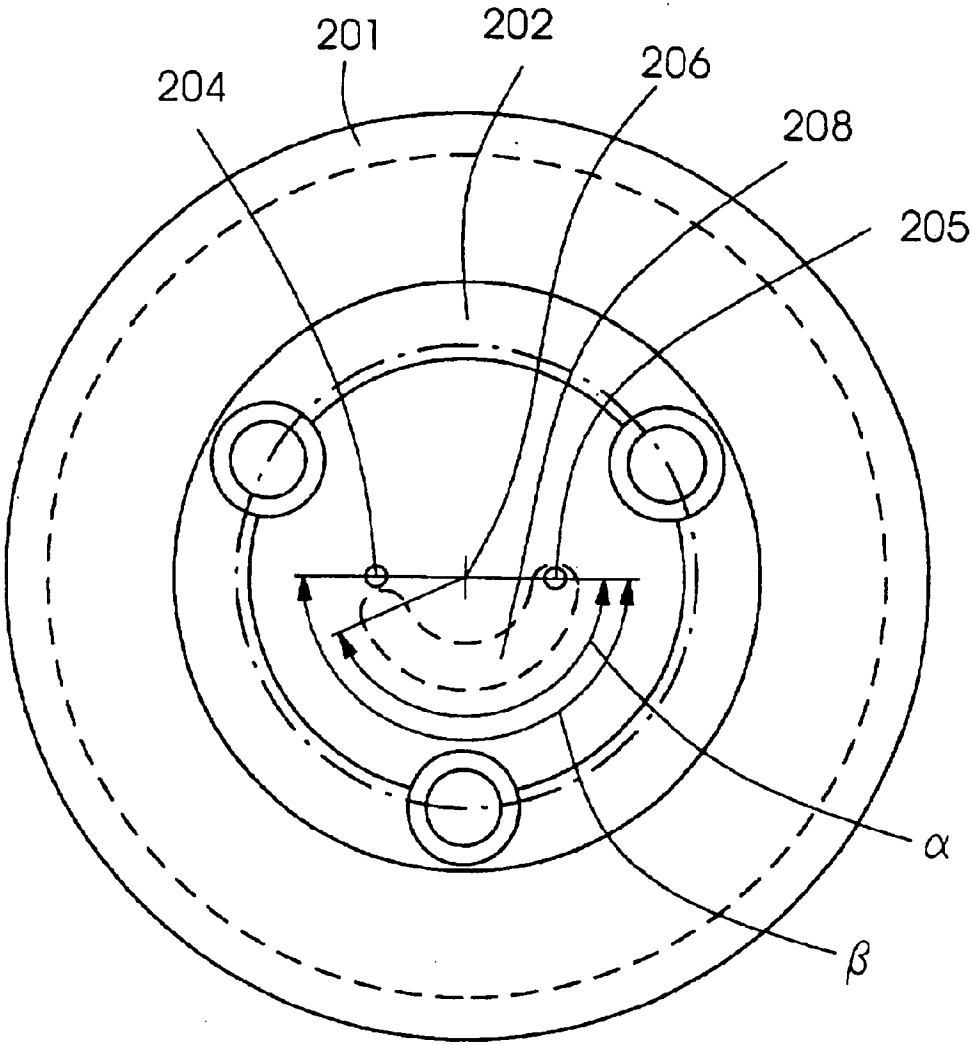

In the second exemplary embodiment of the rotating lead-through shown in FIGS. 2 and 4, the threshold value valve 215 is disposed outside the piston 203 but inside the stator 202. The valve element 216 is a ball and, when the threshold value valve 215 is closed, is pressed by the valve spring 218 onto a valve seat 225 surrounding the valve opening 217. When the threshold value valve 215 is open, the valve element 216 is lifted slightly off the valve seat 225 against the return action of the valve spring 218, which is compressed in the process, so that the operating fluid can flow from a first connecting duct 221 in the stator 202 through the threshold value valve 215 and the valve opening 217 thereof into a second connecting duct 222 provided in the stator 202. The threshold value valve 215 corresponds to a reversing valve, in terms of construction, but not in terms of function (intended purpose). The first connecting duct 221 connects the expansion chamber 211 to the threshold value valve 215. The second connecting duct 222 begins at the threshold value valve 215 and ends in a stator outlet opening 226. In principle, the first connecting duct 221 and the second connecting duct 222 form a single, common flow duct, into which the threshold value valve 215 is integrated.

It is also conceivable, in a departure from the construction of the threshold value valve 215 shown in FIG. 2, to place the latter outside the stator 202 as well as outside the piston 203, for example within a tube hanging out of the stator 202 and disposed between the first connecting duct 221 and the second connecting duct 222.

The stator outlet opening 226 has large dimensions, matched to the actuating travel of the piston 203, in order that, in any position at the piston 203, i.e., both when the piston 203 is held pressed against the stop surface 207 by the operating fluid, and when the piston 203 is held back from the stop surface 207 by the return spring 214, the stator outlet opening 226 overlaps a piston inlet opening 227 on the circumferential side. A third connecting duct 228, which is introduced into the piston 203 and is formed of two bores meeting at an angle, begins in the piston inlet opening 227 and ends in the piston outlet opening 208. When the threshold value valve 214 is open, the operating fluid flows from the stator outlet opening 226 into the piston inlet opening 208.

It is believed to be apparent from FIGS. 3 and 4 that the respective piston outlet opening 108, 208 is a finite circularly arcuate groove running in a curve around the respective rotational axis 106, 206. This groove extends over a circular arc of less than 360° and, therefore, has a beginning and an end, i.e., the groove is not an annular groove.

A first centric angle $\alpha$ determined by the circular arc and groove length, respectively, of the respective piston outlet opening 108, 208 is smaller than a second centric angle $\beta$ lying between the respective rotor inlet openings 104, 105; 204, 205, so that assurance is provided that the respective piston outlet opening 108, 208 can overlap at most a single one of the respective rotor inlet openings 104, 105; 204, 205 and can never simultaneously overlap both respective rotor inlet openings 104, 105; 204, 205. In a non-illustrated specific rotational position which the respective rotor 101, 201 is able to assume relative to the respective piston 103, 203 and which serves for pneumatically actuating the first device (front clamping device), the respective piston outlet opening 108, 208 does not overlap the respective second rotor inlet opening 105, 205 and overlaps only the respective first rotor inlet opening 104, 204, so that the operating fluid flows from the respective piston outlet opening 108, 208 into the respective first rotor inlet opening 104, 204. In this regard, the respective second rotor inlet opening 105, 205 not required for actuating the first device is overlapped by the respective first piston end 109, 209 and is therefore kept closed.

In another rotational position of the respective rotor 101, 201, shown in FIGS. 3 and 4, which serves for pneumatically actuating the second device (rear clamping device), the respective piston outlet opening 108, 208 only overlaps the respective second rotor inlet opening 105, 205, so that the operating fluid flows from the respective piston outlet opening 108, 208 only into the respective second rotor inlet opening 105, 205. In this regard, the respective first rotor inlet opening 104, 204, through which the operating fluid does not flow (inactive) during the actuation of the second device, is kept closed by the respective first piston end 109, 209.

In a departure from the illustrated exemplary embodiments, wherein the respective rotor 101, 201 is rotated relative to the respective stator 102, 202 and to the respective piston 103, 203 about the respective rotational axis 106, 206 in order to select the respective one of the two rotor inlet openings 104, 105; 204, 205 to be deactivated or opened, it is likewise conceivable, for the same purpose instead to rotate the respective stator 102, 202, together with the respective piston 103, 203 inserted therein, relative to the respective rotor 101, 201.

Regardless of whether the rotary lead-through or bushing according to the invention is constructed in accordance with the first exemplary embodiment (note FIGS. 1 and 3) or the second exemplary embodiment (note FIGS. 2 and 4), the rotary lead-through or bushing functions as follows:

In a first method step, the respective rotor 101, 201 is rotated by an electric motor into a rotational position and then held therein, the respective second rotor inlet opening 105, 205 but not the respective first rotor inlet opening 104, 204 being exactly opposite the respective piston outlet opening 108, 208 in this rotational position of the respective rotor 101, 201. In a second method step, the respective piston 103, 203 is extended out of the respective stator 102, 202, by a build-up of excess or positive pressure of the operating fluid sufficient for this purpose in the respective expansion chamber 111, 211 by the respective pressure generator 112, 212.

Only after the respective first piston end 109, 209 has already been pressed tightly (in an airtight manner) against the respective stop surface 107, 207 which stops the outward movement of the respective piston 103, 203, does the respective threshold value valve 115, 215 switch through automatically in a third method step, so that only then can the operating fluid flow out of the respective expansion chamber 111, 211 through the respective threshold value valve 115, 215 and, via the respective openings 105, 108; 205, 208 kept coupled with one another, into the respective rotor 101, 201 and towards the second device (rear clamping device) in order to actuate the latter (release the clamping).

In a fourth method step, the excess or positive pressure of the operating fluid prevailing in the respective expansion chamber 111, 211 is reduced, for example by a switching-off of the respective pressure generator 112, 212. As a result, the respective threshold value valve 115, 215 initially closes again and then the respective piston 103, 203 moves into the respective stator 102, 202 again. The respective return spring 114, 214 and the respective valve spring 118, 218 are matched to one another with respect to the spring characteristic curves thereof, so that when the excess or positive pressure is reduced, the respective threshold value valve 115, 215 is closed by the respective valve spring 118, 218 thereof first, and only then is the respective piston 103, 203 forced into the respective stator 102, 202 by the respective return spring 114, 214.

In a fifth method step, as a result of rotation of the respective rotor 101, 201 by an electric motor, the respective second rotor inlet opening 105, 205 is moved out of overlap, and the respective first rotor inlet opening 104, 204 is moved into overlap with the respective piston outlet opening 108, 208.

Thereafter, in a sixth method step, by the respective pressure generator 112, 212, the respective piston 103, 203 is moved out of the respective stator 102, 202 again by being acted upon by the operating fluid, until a connection between the respective piston outlet opening 108, 208 and the respective first rotor inlet opening 104, 204 is reached, that connection being sealed off (airtight) with respect to the environment. Only when this is the case does the pressure of the operating fluid on the respective valve element 116, 216 have the effect of displacing the latter and, as a result, opening the respective valve opening 117, 217 so that the operating fluid can flow through the respective threshold value valve 115, 215 and, via the respective two openings 104, 204; 108, 208 coupled with one another, into the respective rotor 101, 201 and towards the second device (front clamping device) of the respective rotor 101, 201, in order to actuate this second device (release the clamping).

We claim:

1. In a machine for processing printing material, a rotary lead-through assembly for supplying an operating fluid to a rotor having a rotor inlet opening, the rotary lead-through assembly comprising:

an operating cylinder including an expansion chamber, and a piston having a piston outlet opening, said piston being mounted to be displaced towards the rotor for coupling the rotor inlet opening and said piston outlet opening with one another;

a pressure generator connected both to said expansion chamber and to the rotor upon coupling the rotor inlet opening and said piston outlet opening with one another; and a threshold value valve disposed between said expansion chamber and said piston outlet opening, said valve being automatically opened upon exceeding a given threshold value of an excess pressure of the operating fluid, said threshold value valve having a valve element different from said piston of said operating cylinder.

2. The rotary lead-through assembly according to claim 1, wherein said threshold value valve has a valve spring serving for determining said threshold value, said valve element to be loaded by said valve spring.

3. The rotary lead-through assembly according to claim 2, wherein said valve element is mounted to be displaced away from a valve opening of said threshold value valve under increasing tensioning of said valve spring.

4. The rotary lead-through assembly according to claim 1, wherein said piston outlet opening is a circularly arcuate groove formed at an end of said piston.

5. A machine for processing printing material, comprising:

a rotor having a rotor inlet opening; and a rotary lead-through assembly for supplying an operating fluid to said rotor, said rotary lead-through assembly including:

an operating cylinder including an expansion chamber, and a piston having a piston outlet opening, said piston being mounted to be displaced towards said rotor for coupling said rotor inlet opening and said piston outlet opening with one another;

a pressure generator connected both to said expansion chamber and to said rotor upon coupling said rotor inlet opening and said piston outlet opening with one another; and a threshold value valve disposed between said expansion chamber and said piston outlet opening, said valve being automatically opened upon exceeding a given threshold value of an excess pressure of the operating fluid, said threshold value valve having a valve element different from said piston of said operating cylinder.

* * * * *